US005340489A

United States Patent [19]

Nader et al.

[11] Patent Number: 5,340,489

[45] Date of Patent: Aug. 23, 1994

[54] ARYL ARENESULFONATES AND A METHOD OF LUBRICATION USING THE ARYL ARENESULFONATES

[75] Inventors: Bassam S. Nader, Midland; Chester E. Pawloski, Bay City, both of Mich.

[73] Assignee: The Dow Chemical Company, Midland, Mich.

[21] Appl. No.: 996,548

[22] Filed: Dec. 24, 1992

Related U.S. Application Data

[63] Continuation-in-part of Ser. No. 894,495, Jun. 5, 1992, abandoned.

[51] Int. Cl.[5] ..... C10M 135/10

[52] U.S. Cl. ..... 252/48.6; 252/48.2; 252/48.4; 252/9.0

[58] Field of Search ..... 252/48.2, 48.4, 48.6

[56] References Cited

U.S. PATENT DOCUMENTS

| | | | |
|---|---|---|---|
| 2,610,164 | 9/1952 | Gluesenkamp et al. | 260/30.8 |
| 2,819,211 | 1/1958 | Mikeska et al. | 252/42.1 |
| 2,998,453 | 8/1961 | Nichols | 252/48.2 |
| 2,998,454 | 8/1961 | Nichols | 252/48.2 |
| 3,121,104 | 2/1964 | Burt | 260/456 |
| 3,449,440 | 6/1969 | Anderson | 252/48.2 |
| 3,654,323 | 4/1972 | Clark et al. | 260/400 |
| 3,690,815 | 9/1972 | Dellian | 8/589 |
| 4,277,417 | 7/1981 | Varma | 260/456 R |
| 4,569,777 | 2/1986 | Miller et al. | 252/77 |
| 5,066,409 | 11/1991 | Nader | 252/48.2 |
| 5,072,049 | 12/1991 | Stumpp et al. | 568/33 |
| 5,093,155 | 3/1992 | Miyazaki et al. | 427/177 |
| 5,204,011 | 4/1993 | Nader | 252/48.2 |

FOREIGN PATENT DOCUMENTS

| | | |
|---|---|---|
| 168021 | 1/1954 | Australia . |
| 453717 | 12/1948 | Canada . |
| 1242781 | 6/1967 | Fed. Rep. of Germany . |
| 1064595 | 4/1967 | United Kingdom . |

*Primary Examiner*—Ellen M. McAvoy
*Attorney, Agent, or Firm*—Robert M. O'Keefe

[57] ABSTRACT

A method for lubricating inorganic surfaces which comprises applying an aryl arenesulfonate between two inorganic surfaces in an amount sufficient to decrease the friction between the two surfaces, wherein the aryl arenesulfonate is of the formula $ASO_3A$, $ASO_3BSO_3A$, or $(ASO_3)_3B$ wherein A is independently in each occurrence phenyl or substituted phenyl, wherein when A is substituted phenyl the phenyl can be substituted by halo, a ketone substituted by an aromatic group or alkyl group, alkyl, polyhaloalkyl, alkoxy, polyhaloalkoxy, aryl, aralkyl, haloaryl, aryloxy, polyhaloaryloxy, polyhaloalkylaryl, or polyhaloalkylaryloxy, and wherein B is benzene or two benzene rings connected by a divalent bridging group selected from the group consisting of $C(CH_3)_2$, O, $OCH_2$, $OCH_2CH_2$, $OCH_2CH_2O$, $C(CF_3)_2$, S, $SO_2$, CO, and 9,9'-fluorene.

17 Claims, No Drawings

ARYL ARENESULFONATES AND A METHOD OF LUBRICATION USING THE ARYL ARENESULFONATES

This application is a continuation-in-part of co-pending application Ser. No. 07/894,495, filed June 5, 1992. now abandoned.

BACKGROUND OF THE INVENTION

This invention relates to high temperature lubricants. There are only a few classes of compounds that qualify as high temperature fluids, that is, fluids used at temperatures above 300° C. These materials are used, for example, as lubricants in modern jet aircraft. A well known class of such fluids are the polyaryl ethers such as polyphenyl ether. Since these fluids are important to the functioning of high performance aircraft, it is desirable to develop new materials suitable as high temperature lubricants.

SUMMARY OF THE INVENTION

This invention, in one respect, is a method for lubricating inorganic surfaces which comprises applying an aryl arenesulfonate between two inorganic surfaces in an amount sufficient to decrease the friction between the two surfaces, wherein the aryl arenesulfonate is of the formula $ASO_3A$, $ASO_3BSO_3A$, or $(ASO_3)_3B$ wherein A is independently in each occurrence phenyl or substituted phenyl, wherein when A is substituted phenyl the phenyl can be substituted by halo, a ketone substituted by an aromatic group containing up to 12 carbon atoms or alkyl group containing up to 10 carbon atoms, alkyl containing up to 10 carbon atoms, polyhaloalkyl containing up to 10 carbon atoms, alkoxy containing up to 10 carbon atoms, polyhaloalkoxy containing up to 10 carbon atoms, aryl containing up to 12 carbons, aralkyl wherein the aryl group contains up to 12 carbon atoms and the alkyl group contains up to 10 carbon atoms, haloaryl containing up to 12 carbons and substituted by up to 10 halo groups, aryloxy containing up to 12 carbons, polyhaloaryloxy containing up to 12 carbons, polyhaloalkylaryl wherein the aryl group contains up to 12 carbon atoms and wherein the alkyl group contains up to 10 carbon atoms, or polyhaloalkylaryloxy wherein the aryl group contains up to 12 carbon atoms and wherein the alkyl group contains up to 10 carbon atoms, and wherein B is benzene or two benzene rings connected by a divalent bridging group selected from the group consisting of $C(CH_3)_2$, O, $OCH_2$, $OCH_2CH_2$, $OCH_2CH_2O$, $C(CF_3)_2$, S, $SO_2$, CO, and 9,9'-fluorene.

DETAILED DESCRIBED DESCRIPTION OF THE INVENTION

The aryl arenesulfonates of this invention contain one, two, or three sulfonate groups (—$SO_3$—) wherein each sulfonate group is attached to two aryl groups. As defined herein, aryl arenesulfonates of this invention are of the formula $ASO_3A$, $ASO_3BSO_3A$, or $(ASO_3)_3B$ wherein A is independently in each occurrence phenyl or substituted phenyl, and wherein B is benzene or two benzene rings connected by a divalent bridging group. Aryl arenedisulfonates can be of the formula $ASO_3Ph(XPh)_ySo_3A$ wherein y is O or 1 and wherein X is a divalent bridging group such as $C(CH_3)_2$, O, $OCH_2$, $OCH_2CH_2$, $OCH_2CH_2$, $C(CF_3)_2$, S, $SO_2$, CO, and 9,9'-fluorene, preferably $C(CH_3)_2$, O, $C(CF_3)_2$, S, CO, and 9,9'-fluorene. When B is benzene and the aryl arenesulfonate is a disulfonate, the $SO_3A$ groups can be attached in ortho, meta, or para arrangement. When B is two benzene rings connected by a bridging group, each benzene of B can be connected independently in meta or para arrangement. For all of the formulas above, when A is substituted phenyl, the phenyl can be substituted by halo, a ketone substituted by an aromatic group containing up to 12 carbon atoms or alkyl group containing up to 10 carbon atoms, alkyl containing up to 10 carbon atoms, polyhaloalkyl containing up to 10 carbon atoms, alkoxy containing up to 10 carbon atoms, polyhaloalkoxy containing up to 10 carbon atoms, aryl containing up to 12 carbons, aralkyl wherein the aryl group contains up to 12 carbon atoms and the alkyl group contains up to 10 carbon atoms, haloaryl containing up to 12 carbons and substituted by up to 10 halo groups, aryloxy containing up to 12 carbons, polyhaloaryloxy containing up to 12 carbons, polyhaloalkylaryl wherein the aryl group contains up to 12 carbon atoms and wherein the alkyl group contains up to 10 carbon atoms, or polyhaloalkylaryloxy wherein the aryl group contains up to 12 carbon atoms and wherein the alkyl group contains up to 10 carbon atoms. The substituent of the phenyl group can be ortho, meta, or para to the sulfonate group. Preferred alkyl substituents contain up to 8 carbons. More preferred alkyl substituents include methyl, t-butyl, and 1,1,3,3-tetramethylbutyl. A preferred polyhaloalkylaryl substituent is trifluoromethylphenyl. Preferred alkoxy substituents contain up to seven carbon atoms. More preferred alkoxy substituents include methoxy, n-butoxy, n-hexoxy, and n-heptoxy. Preferred aryl substituents include alkylphenyls, tri-t-butylphenyl, and halophenyls. A preferred halophenyl is fluorophenyl. Preferred polyhaloalkoxy substituents include 1,1,3,3,3-pentafluro-n-propoxy, 1,1,2,3,3,3-hexafluoro-n-propoxy, and trifluoromethoxy. A preferred polyhaloalkyl is polyfluoroalkyl of less than eight carbon atoms, more preferably the polyhaloalkyl substituent is trifluoromethyl. A preferred halo group is fluoro. Preferred aryloxy substituents are phenoxy and halophenoxy, more preferably phenoxy. Preferred ketone substituents include methyl ketone and phenyl ketone. More preferred aryl arenesulfonates of this invention are of the formula $ASO_3A$ or $ASO_3BSO_3A$.

Examples of the aryl arenesulfonates of this invention are of Formula I:

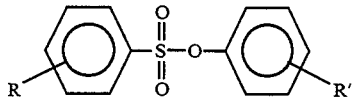

wherein R is hydrogen, 4-methyl, 4-t-butyl, 4-methoxy, 4-n-butoxy, 4-phenoxy, 4-trifluoromethoxy, or 4-(1,1,3,3,3-hexafluoro)-n-propoxy; R' is hydrogen, 4-t-butyl, 3-methoxy, 4-methoxy, 3-n-butoxy, 3-phenoxy, 4-(1,1,3,3-tetra methyl)butyl, 2-t-butyl, 4-n-heptoxy, 4-methyl, 2-t-butyl, 4-n-butoxy, 4-n-hexoxy, 3-methyl, 3-fluoro, 3-trifluoromethyl, 4-methyl ketone, or 4-phenyl ketone; of Formula II:

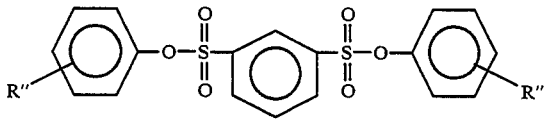

wherein R″ is 3-methoxy, 3-trifluoromethyl, 3-phenoxy, 4-phenoxy, 4-(4-chloro)phenoxy, or 1,1,3,3-tetramethylbutyl; of Formula III:

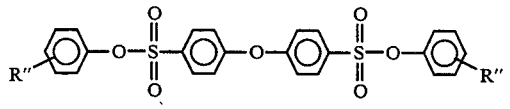

wherein R″ is as defined above; of Formula IV:

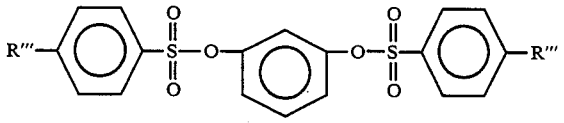

wherein R‴ is 1,1-dimethylpropyl, t-butyl, methoxy, n-butoxy, or phenoxy; of Formula V:

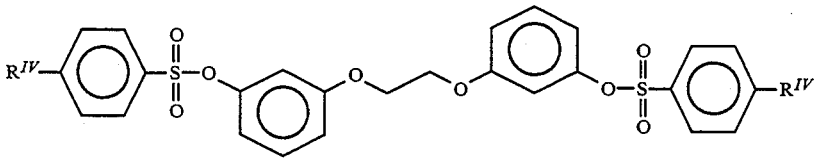

wherein $R^{IV}$ is n-butoxy; of Formula VI:

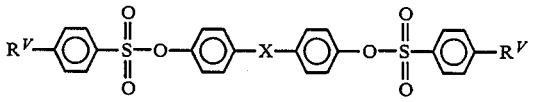

wherein $R^{V}$ is hydrogen, t-butyl, n-butoxy; X is dimethylmethylene, ditrifluoromethylmethylene, oxygen, sulfur, $SO_2$, CO, or 9,9-fluorene; of Formula VII:

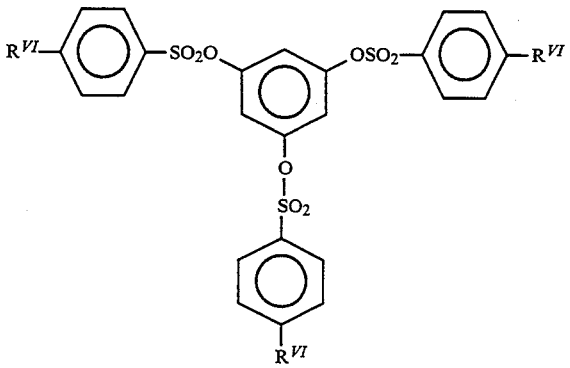

wherein $R^{VI}$ is t-butyl or n-butoxy; or of Formula VIII:

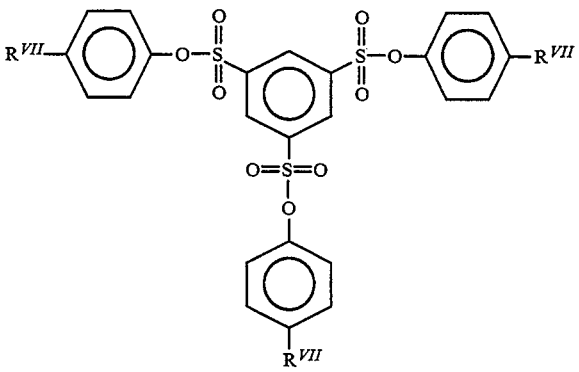

wherein $R^{VII}$ is 1,1,3,3-tetramethylbutyl.

Examples of the most preferred aryl arenesulfonates of this invention are of Formula I wherein R is hydrogen, 4-methyl, 4-t-butyl, 4-methoxy, 4-n-butoxy, 4-phenoxy, 4-trifluoromethoxy, or 4-(1,1,2,3,3,3-hexafluoro)-n-propoxy; R′ is hydrogen, 4-t-butyl, 3-methoxy, 4-methoxy, 3-n-butoxy, 3-phenoxy, 4-(1,1,3,3-tetra methyl)butyl, 2-t-butyl, 4-n-heptoxy, 4-methyl, 2-t-butyl, 4-n-butoxy, 4-n-hexoxy, 3-methyl, 3-fluoro, 3-trifluoromethyl, 4-methyl ketone, or 4-phenyl ketone, or of Formula II wherein R″ is 4-butoxy, 3-methoxy, 3-trifluoromethyl, 3-phenoxy, 4-phenoxy, 4-(4-chloro)-phenoxy, or (1,1,3,3-tetramethyl)butyl.

The aryl arenesulfonates of this invention are typically prepared by reacting an arenesulfonyl chloride with phenol or substituted phenol under conditions effective to form the aryl arenesulfonate. This reaction is preferably carried out in the presence of an organic solvent, more preferably an anhydrous organic solvent. Examples of preferred solvents include pyridine, benzene, quinoline, diglyme, triethylamine, dimethyl sulfoxide, dimethyl formamide, n-methyl pyrrolidinone, N,N′-dimethyl acetamide, hexamethylphosphoramide, sulfolane, and toluene. A catalyst can also be used such as 4-dimethylaminopyridine. The products of the reaction are generally separated and purified by conventional techniques such as chromatography.

Examples of suitable arenesulfonyl chlorides suitable for starting materials in the reaction to make aryl arenesulfonates of this invention include benzenesulfonyl chloride substituted by halo, ketone, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloalkylaryloxy groups. The substituent of the arenesulfonyl chloride can be in ortho, meta, or para arrangement. When the arenesulfonyl chloride is substituted by an alkyl group, preferred alkyls contain up to 8 carbons. More preferred alkyls include methyl, t-butyl, and 1,1,3,3-tetramethylbutyl. When the arenesulfonyl chloride is substituted by an alkoxy group, preferred alkoxy groups contain up to seven carbon atoms. More preferred alkoxy groups include methoxy, n-butoxy, n-hexoxy, and n-heptoxy. Preferred arene groups of an arenesulfonyl chloride include alkylphenyls, tri-t-butylphenyl, and halophenyls such as fluorophenyl. Preferred polyhaloalkoxy groups of an arenesulfonyl chloride include 1,1,3,3,3-pentafluoro-n-propoxy, 1,1,2,3,3,3-hexafluoro-n-propoxy, and trifluoromethoxy. A preferred polyhaloalkyl is trifluoromethyl. A preferred halo group is fluoro. A preferred aryloxy group of an arenesulfonyl chloride is phenoxy. Preferred ketone groups include methyl ketone and phenyl ketone. More preferred arenesulfonyl chlorides are benzenesulfonyl chloride substituted by 3-methyl, 4-methyl, 2-t-butyl, 4-t-butyl, 4-(1,1,3,3-tetramethyl)butyl, 3-trifluoromethyl, 3-methoxy, 4-methoxy, 3-n-butoxy, 4-n-butoxy, 4-n-hexoxy, 4-n-heptoxy, 4-trifluoromethoxy, 4-(1,1,2,3,3,3-hexafluoro)-n-propoxy, 3-phenoxy, 4-phenoxy, 3-fluoro, 4-methyl ketone, or 4-phenyl ketone groups. If an aryl arenedisulfonate is desired, the disulfonate can be produced by employing either a benzenediol such as 1,4-benzenediol and 1,3-benzenediol or by using as a starting material a benzenedisulfonyl chloride such as 1,3-benzenedisulfonyl chloride and 1,4-benzenedisulfonyl chloride. Similarly, when "B" represents two benzene rings linked by a bridging group, the starting material can be a diol or disulfonyl chloride of "B". Likewise, when an aryl arenetrisulfonate is desired, the trisulfonate can be produced by employing either 1,3,5-benzenetriol, described hereinbelow, or by using as a starting material a trisulfonyl chloride such as 1,3,5-benzenetrisulfonyl chloride.

Examples of phenols suitable as starting material in the reaction to make aryl arenesulfonates of this invention include phenol, substituted phenol, 1,4-benzenediol, 1,3-benzenediol, and 1,3,5-benzenetriol. Examples of substituted phenols include phenol substituted by halo, ketone, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloalkylaryloxy groups. The substituted phenol can be of ortho, meta, or para arrangement. When the substituted phenol is substituted by an alkyl group, preferred alkyls contain up to 8 carbons. More preferred alkyls include methyl, t-butyl, and 1,1,3,3-tetramethylbutyl. When the substituted phenol is substituted by an alkoxy group, preferred alkoxy groups contain up to seven carbon atoms. More preferred alkoxy groups include methoxy, n-butoxy, n-hexoxy, and n-heptoxy. Preferred aryl groups of a substituted phenol include alkylphenyls, tri-t-butylphenyl, and halophenyls such as fluorophenyl. Preferred polyhaloalkoxy groups of a substituted phenol include 1,1,3,3,3-pentafluoro-n-propoxy, 1,1,2,3,3,3-hexafluoro-n-propoxy, and trifluoromethoxy. A preferred polyhaloalkyl is trifluoromethyl. A preferred halo group is fluoro. A preferred aryloxy group of a substituted phenol is phenoxy. Preferred ketone groups include methyl ketone and phenyl ketone. More preferred substituted phenols are phenols substituted by 3-methyl, 4-methyl, 2-t-butyl, 4-t-butyl, 4-(1,1,3,3-tetra-methyl)butyl, 3-trifluoro-methyl, 3-methoxy, 4-methoxy, 3-n-butoxy, 4-n-butoxy, 4-n-hexoxy, 4-n-heptoxy, 4-trifluoromethoxy, 4-(1,1,2,3,3,3-hexa-fluoro)-n-propoxy, 3-phenoxy, 4-phenoxy, 3-fluoro, 4-methyl ketone, or 4-phenyl ketone groups.

The lubricity of lubricant compositions may be measured by applying a standard test method as described in ASTM D-2783, "Standard Method for Measurement of Extreme Pressure Properties of Lubricating Fluids (Four-ball Method)." In addition, the aryl arenesulfonates of this invention are advantageously thermally and oxidatively stable when used in high temperature applications. The useful lifetime of aryl arenesulfonates as lubricants is closely related to the oxidative stability of the compounds. The oxidative stability of the aryl arenesulfonates can be determined by employing pressure differential scanning calorimetry (PDSC). R. L. Blaine describes this procedure in a technical paper, "Oxidative Stability of Oils and Greases," Thermal Analysis, Number TA 41 available from the DuPont Company and in "Thermal Analytical Characterization of Oils and Lubricants," *American Laboratory*, Vol. 6(1), pages 18–20, 22, (January, 1974), and by P. F. Levy et al. in *Thermochim. Acta*, Vol. 1, page 429 (1970).

In the method for lubricating inorganic surfaces of this invention, the aryl arenesulfonates defined above are applied between two inorganic surfaces which intermittently or continuously make contact, the aryl arenesulfonate being applied in an amount sufficient to decrease the friction between the two inorganic surfaces. Examples of inorganic materials which can be lubricated using aryl arenesulfonates of this invention include metals, mixed metals, metal oxides, and ceramics. The amount of aryl arenesulfonate which is applied to the surface is any amount that decreases the friction between the two inorganic surface when in intimate contact. In this regard, the aryl arenesulfonate can be present as a layer of varying thickness. The amount of aryl arenesulfonate needed to provide a desired lubricating effect will vary depending on the application. The aryl arenesulfonate can be applied between the inorganic surfaces by any method such as by brushing, spraying, pouring, and the like, and may be applied intermittently or continuously such as in aircraft or other engines.

In the practice of this invention, the aryl arenesulfonate can be used as a lubricating composition containing greater than 50 weight percent aryl arenesulfonate, preferably greater than 75 weight percent, more preferably greater than 90 weight percent. 100 percent aryl arenesulfonate can also be employed. When a lubricating composition containing aryl arenesulfonate is employed having greater than 50 weight percent aryl arenesulfonate and less than 100 percent aryl arenesulfonate, the balance of the composition can be made up of well known additives used in lubricants such as lubricity enhancing additive, antiwear additives, anticorrosion additives, and antioxidants.

The method of this invention is generally conducted at a temperature in the range from about 150° C. to about 350° C. Within this range, a temperature of about 200° C. to about 325° C. is preferred.

The following examples are given to illustrate the invention and should not be interpreted as limiting it in any way. Unless stated otherwise, all parts and percentages are given by weight. All reactions requiring anhydrous conditions are performed in oven-dried glassware which was cooled under nitrogen.

EXAMPLE 1

Preparation of Phenyl Benzenesulfonate

All apparatus is rigorously dried and flushed with nitrogen before use. The reaction is performed in a 25 ml flask equipped with a magnetic stirring bar and a calcium chloride drying tube. The flask is charged with benzenesulfonyl chloride (11.60 g, 65.7 mmol), phenol (5.60 g, 59.6 mmol), and 4-dimethylaminopyridine (0.36 g, 2.98 mmol), and anhydrous pyridine (20 ml). The reaction mixture is stirred and heated at reflux, and the progress of the reaction is monitored by high performance liquid chromatography. At the conclusion of the reaction, the mixture is cooled and quenched with water (25 ml), extracted with ether (50 ml), and washed successively with 50 ml portions of water, 5% sodium hydroxide (2×), water, and brine. The organic phase is then dried over magnesium sulphate, filtered, and concentrated to yield 13.1 g (94%) of the crude product as a yellow oil. This product is further purified by distillation on a Kugelrohr apparatus under vacuum to give 11.3 g (81%) of the product as a colorless oil. The oxidative stability of the product is determined by pressure differential scanning calorimetry (PDSC). The results are reported below in Table 1.

EXAMPLE 2

Preparation of Several Aryl Arenesulfonates

Several aryl arenesulfonates are prepared in accordance with the procedure of Example 1 except that the corresponding starting materials are selected to provide the aryl arenesulfonates shown in Table 1 below. Compounds A-G, J-O, S, and T are oils. Compounds H, I, P, R, V, and W are thick oils. Compounds Q and U are very thick oils. The oxidative stability of the aryl arenesulfonates is shown in Table 1. The data for PDSC shows onset of oxidation and extrapolated oxidation points (°C.), the first number being the onset of oxidation.

In Table 1 , the left hand column denotes R and R′ which correspond to the formula

TABLE I

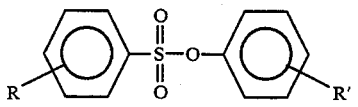

| Compound | R | R′ | PDSC |
|---|---|---|---|
| A. | H | H | 280/318 |
| B. | H | 3-$CH_3O$ | 319/339 |
| C. | H | 3-$CH_3(CH_2)_2CH_2O$ | 270/339 |
| D. | 4-$C(CH_3)_3$ | H | 303/335 |
| E. | 4-$C(CH_3)_3$ | 3-$CH_3O$ | 286/327 |
| F. | 4-$C(CH_3)_3$ | 3-$CH_3(CH_2)_2CH_2O$ | 262/300 |
| G. | 4-$C(CH_3)_3$ | 4-$CH_3(CH_2)_5CH_2O$ | 243/282 |
| H. | 4-$CH_3O$ | 2-$C(CH_3)_3$ | 242/297 |
| I. | 4-$CH_3O$ | 4-$C(CH_3)_3$ | 296/331 |
| J. | 4-$CH_3O$ | 3-$CH_3O$ | 282/322 |
| K. | 4-$CH_3O$ | 4-$CH_3(CH_2)_5CH_2O$ | 260/272 |
| L. | 4-$CH_3(CH_2)_2CH_2O$ | 3-$CH_3(CH_2)_2CH_2O$ | 264/294 |
| M. | 4-$CH_3(CH_2)_2CH_2O$ | 4-$CH_3(CH_2)_4CH_2O$ | 246/277 |
| N. | 4-$CH_3(CH_2)_2CH_2O$ | 4-$CH_3(CH_2)_5CH_2O$ | 266/278 |
| O. | 4-PhO | H | 211/357 |
| P. | 4-PhO | 3-$CH_3$ | 238/291 |
| Q. | 4-PhO | 2-$C(CH_3)_3$ | 238/291 |
| R. | 4-PhO | 4-$C(CH_3)_2CH_2C(CH_3)_3$ | 288/326 |
| S. | 4-PhO | 3-F | 337/362 |
| T. | 4-PhO | 3-$CF_3$ | 340/360 |
| U. | 4-PhO | 4-$CH_3C(=O)$ | 268/294 |
| V. | 4-$CF_3O$ | 4-$C(CH_3)_2CH_2C(CH_3)_3$ | 261/287 |
| W. | 4-$CF_3CFHCF_2O$ | 4-$C(CH_3)_2CH_2C(CH_3)_3$ | 265/320 |

EXAMPLE 3

1,3-Bis[4-n-butoxybenzenesulfonyloxy]benzene

The procedure of Example 1 is substantially repeated except two equivalents of 4-n-butoxybenzenesulfonyl chloride is substituted for the benzenesulfonyl chloride and 1,3-benzenediol is substituted for the phenol. The resulting disulfonate is a thick oil having PDSC onset-/extrapolated temperatures of 286/292.

The data in Examples 1–3 shows that the aryl arenesulfonates of this invention have significant stability as demonstrated by the high temperatures at which the compounds begin oxidation. Thus, since these are oils having high stability, the aryl arenesulfonates are useful lubricants.

EXAMPLE 4

Preparation of Bis[3(phenoxy)phenoxy]1,3benzenedisulfonate

All apparatus is rigorously dried and flushed with nitrogen before use. The reaction is performed in a 25 ml flask equipped with a magnetic stirring bar and a $CaCl_2$ drying tube. The flask is charged with benzene-1,3-disulfonyl chloride (2.75 grams, 10 mmol), 3-phenoxyphenol (3.72 grams, 20 mmol), and 4-dimethylaminopyridine (60 mg, 0.5 mmol), and anhydrous pyridine (10ml). The mixture is stirred for 2 hours at ambient temperature. The product is separated by admixing the mixture with water (20 ml) and ethyl ether (30 ml), isolating the organic phase and washing with 25ml portions of 5 percent HCl (3×), water, 5 percent NaOH, water, and saturated brine, then drying with $MgSO_4$. The organic phase is filtered and is concentrated to leave 3.04 grams of a thick yellow oil. The yellow oil is purified by column chromatography using flash grade silica gel and using 1:1 pentane-$CH_2Cl_2$ initially and then $CH_2C_2$ as the eluent. An almost colorless, viscous oil is obtained (2.99 grams, 52 percent yield) of the title compound.

A yield of 84 percent is obtained at 3 times the above scale when the mixture is heated at reflux for 20 hours.

EXAMPLE 5

Preparation of 4-(1,1,3,3-Tetramethyl-butyl)phenyl 4-(tert-butyl)benzenesulfonate An oven-dried 50 ml 3-necked flask is equipped with a magnetic stirring bar and a $CaCl_2$ drying tube and is charged with 4-tert-butylsulfonyl chloride (7 grams, 30 mmol), 4-(1,1,3,3-tetramethylbutyl)phenol (6.2 grams, 30 mmol), 4-dimethylaminopyridine (0.18 gram, 1.5 mmol), and anhydrous pyridine (20 ml). The mixture is stirred at ambient temperature for 24 hours, then a reflux condenser is attached, and the mixture is heated at reflux for 1 hour. Workup consists of partitioning the mixture between $Et_2O$ and $H_2O$ (75 ml each), and washing the organic phase successively with 50 ml portions of $H_2O$ (2×), 5 percent HCl (2×), $H_2O$ (2×), 5 percent NaOH, $H_2O$ (2×), and brine, then drying ($MgSO_4$), filtration and concentration. An amber oil (10.63 grams) is recovered. On standing, a crystalline solid is formed. After recrystallization from hexane, collecting three crops, and a subsequent recrystallization of the combined crops, 5.64 grams (47 percent yield) of the title compound is recovered as white prisms, m.p. 68° C. to 71° C.

EXAMPLE 6

Preparation of Bis[3-trifluromethyl)phenyl]1,3-benzenedisulfonate

An oven-dried 50 ml 3-necked flask is equipped with a magnetic stirring bar and a $CaCl_2$ drying tube and is charged with benzene-1,3-disulfonyl chloride (6.9 mmol), α, α, α-trifluoro-m-cresol (6.1 ml, 50 mmol), and 4-dimethylaminopyridine (0.15 gram, 1.25 mmol), and anhydrous pyridine (20 ml) is added. The mixture is stirred at ambient temperature for 24 hours, then a reflux condenser is attached, and the mixture is heated at reflux for 1 hour. Workup consists of partitioning the mixture between $Et_2O$ and $H_2O$ (100 ml each), washing the organic phase successively with 50 ml portions of $H_2O$ (2×), 5 percent HCl (2×), $H_2O$, 5 percent NaOH, $H_2O$(2×), and brine, then drying ($MgSO_4$), filtration and concentration. A pale yellow oily residue (7.06 grams) is collected. HPLC analysis on a reverse phase column shows the product to contain a small amount of residual α, α, α-trifluoro-m-cresol. The latter is effectively removed by steam distillation on the rotavap to give 6.72 grams (50 percent yield) of the pure title compound as a pale yellow oil.

When this run is repeated on the same scale and under similar conditions, except that the reaction mixture is heated at reflux for 20 hours, the crude oily product obtained after workup crystallized on standing, and is recrystallized from MeOH-$H_2O$ (9:1) to give 10.7 grams (81 percent yield) of white prisms, m.p. 59° C. to 60° C.

EXAMPLE 7

Preparation of bis[4-(4-chlorophenoxy)phenyl]1,3-Benzenedisulfonate

A 1 liter 3-necked flask is equipped with a mechanical stirrer, a Dean-Stark trap carrying a reflux condenser, and a heating mantle, and is charged with 4-methoxyphenol (35.9 grams, 0.29 mol), 85 percent KOH (19.1 grams, 0.29 mol),and p-xylene (350 ml). The mixture is heated at reflux for 1 hour, removing the water of reaction azeotropically. Then it is cooled, and 1-chloro-4-iodobenzene (69 grams, 0.29 mol), copper powder (2.9 grams, 46 mmol), and cuprous chloride (2.9 grams, 29 mmol) are added, and the mixture is heated at reflux for 20 hours. Workup consists of diluting the cooled mixture with $Et_2O$ (200 ml), filtration through a medium-fritted funnel, and concentration of the filtrate to leave a deep dark oily residue. This crude material, consisting primarily of 4-(4-chlorophenoxy)anisole, is treated with glacial acetic acid (275 ml) and 48 percent HBr (105 ml), then the mixture is heated at reflux for 24 hours. Workup consists of partitioning the mixture between $H_2O$ (1.2 1) and $CH_2Cl_2$ (0.5 1), washing the organic phase with $H_2O$ (0.5 1), and concentration to leave a deep dark oily residue. This residue is taken up in ethanol (0.5 1) and treated with activated carbon (Norit; ca. 50 grams). Filtration through celite, and concentration of the filtrate gave the crude title compound as a thick, red oil. Further purification of the product is achieved by chromatography on a column packed with flash-grade silica gel (6"×2" i.d.), eluting with $CH_2Cl_2$,to give after concentration a pinkish solid, which is subsequently recrystallized from hexane-EtOAc to give 31.4 grams (49 percent yield) of pure 4-(4-chlorophenoxy)-phenol as off-white prisms, m.p. 85° C. to 86° C.

A 100 ml 3-necked oven-dried flask equipped with a magnetic stirring bar and a $CaCl_2$-Drierite drying tube is charged with 1,3-benzenedisulfonyl chloride (4.3 g, 15.6 mmol), 4-(4-chlorophenoxy)phenol (7 g, 31.7 mmol, 4-dimethylaminopyridine (0.38 g, 3.1 mmol), and anhydrous pyridine (35 ml). The mixture is stirred at ambient temperature for 18 hours, then is partitioned between 10% FHCl (300 ml) and methylene chloride (100 ml), and the organic phase is washed with water (100 ml) and brine (100 ml), dried ($MgSO_4$), filtered and concentrated to leave a thick yellowish oily residue. This material is chromatographed on a column packed with flash-grade silica gel (8"×2" i.d.), eluting initially with pentane-methylene chloride (4:1, v/v), then with methylene chloride. This gave 9.1 g (91% yield) of the title compound in high purity as a thick, clear, faintly yellowish oil, which turned glassy on standing.

EXAMPLE 8

Preparation of 1,3-Bis[4-methoxybenzenesulfonyloxy]benzene

A 25 ml 3-necked flask is equipped with a magnetic stirring bar and a reflux condenser fitted with a $CaCl_2$ drying tube and is charged with resorcinol (2.9 grams, 27 mmol), 4-methoxybenzenesulfonyl chloride (12.1 grams, 58 mmol), pyridine (20 ml), and 4-dimethylaminopyridine (0.2 gram, 1.3 mmol). The stirred mixture is heated at reflux for 10 hours, then is stirred at ambient temperature for 24 hours. Workup consists of partitioning the mixture between $Et_2O$ and $H_2O$ (50 ml each), washing the organic phase successively with 50 ml portions of $H_2O$, 5 percent HCl (2×), $H_2O$, 5 percent NaOH, $H_2O$, and brine, drying ($MgSO_4$), filtration and concentration. This gives 10.5 grams of an amber oil. A crystalline solid is formed by treating with methanol at ambient temperature. Recrystallization twice from MeOH gives 8.8 grams (73 percent yield) of the title compound as white needles, m.p. 81° C. to 84° C.

EXAMPLE 9

Preparation of 2,2-Bis[4-(benzenesulfonyloxy)phenyl]propane

An oven-dried 100 ml 3-necked flask is equipped with a magnetic stirring bar, a reflux condenser carrying a $CaCl_2$-Drierite drying tube, and a heating mantle, and is charged with 4,4'-isopropylidenediphenol (4.5 grams, 19.7 mmol), 4-dimethylaminopyridine (0.48 gram, 3.93 mmol), and anhydrous $Et_3N$ (40 ml). The solution is stirred and treated slowly with benzenesulfonyl chloride (5.7 ml, 44.7 mmol) via syringe. The resulting mixture is heated at reflux for 9 hours. Workup consists of partitioning the reaction mixture between $CH_2Cl_2$ (100 ml) and a mixture of water (150 ml) and concentrated HCl (40 ml), then washing the organic phase successively with 100 ml portions of water, 5 percent NaOH, water, and saturated brine. Drying ($MgSO_4$), filtration and concentration gives 10.6 grams of a deep dark oily residue. TLC analysis on silica gel shows one major component ($R_f$=0.45; $CH_2Cl_2$), and some minor more polar components. Chromatography on a column packed with flash-grade silica gel (6"×1" i.d.), eluting with $CH_2Cl_2$, gives 9.71 grams of a yellow oil. Crystallization from EtOAc-MeOH-$H_2O$ (20 ml:100 ml:10 ml), using seed crystals obtained from a micro-crystallization on a small sample, affords 8.35 grams (83.5 percent yield) of the title compound as a white crystalline solid, m.p. 92° C. to 93° C.

EXAMPLE 10

Preparation of 2,2-Bis[4-(benzenesulfonyloxy)phenyl]-1,1,1,3,3,3-hexafluoropropane An oven-dried 100 ml 3-necked flask is equipped with a magnetic stirring bar, a reflux condenser carrying a $CaCl_2$-Drierite drying tube, and a heating mantle, and is charged with 4,4'-(hexafluoroisopropylidene)diphenol (Aldrich) (5.45 grams, 16.2 mmol), 4-dimethylaminopyridine (0.4 gram, 3.3 mmol), and anhydrous $Et_3N$ (40 ml). The solution is stirred and treated slowly with benzenesulfonyl chloride (4.7 ml, 36.8 mmol) via syringe. The resulting mixture is heated at reflux for 9 hours. Workup consists of partitioning the reaction mixture between $CH2C_2$ (100 ml) and a mixture of $H_2$(150 ml) and concentrated HCl (40 ml), washing the organic phase successively with 100 ml portions of $H_2O$, 5 percent NaOH, $H_2O$ and saturated brine, drying ($MgSO_4$), filtration and concentration. This gives 10.6 grams of a reddish oily residue. TLC analysis on silica gel shows one main component ($R_f$=0.54; $CH_2Cl_2$). Chromatography on a column packed with flash-grade silica gel (3"×1" i.d.), eluting with $CH_2Cl_2$, gives 9.32 grams of a faintly yellowish oil, which solidifies on standing. Recrystallization from EtOAc-MeOH-$H_2O$ (20 ml:100 ml:10 ml)affords 8.91 grams (89 percent yield) of the title compound as a white crystalline solid, m.p. 133° C. to 134° C.

EXAMPLE 11

Preparation of 2,2-Bis[4-(4-tert-butylbenzenesulfonyloxy) phenyl]propane

An oven-dried 50 ml 3-necked flask is equipped with a magnetic stirring bar and reflux condenser carrying a $CaCl_2$ drying tube and is charged with 4-tert-butylbenzenesulfonyl chloride 9.3 grams (40 mmol), 4,4'-isopropylidenediphenol (4.11 grams, 18 mmol), 4-dimethylaminopyridine (0.11 gram, 0.9 mmol), and anhydrous pyridine (20 ml), and the mixture is stirred and heated at reflux for 14 hours. Workup consists of partitioning the mixture between $Et_2O$ and $H_2O$ (50 ml each), washing the organic phase successively with 100 ml portions of $H_2$(2×), 5 percent HCl (2×), $H_2O$, saturated (2×), $H_2O$ and brine, then drying ($MgSO_4$) filtration and concentration. This gives 10.41 grams of a pale yellow sold. Three consecutive recrystallizations from EtOH-MeOH (2:1) affords 7.87 grams (70 percent yield) of the title compound as white prisms, m.p. 124° C. to 127° C.

EXAMPLE 12

Preparation of 2,2-Bis[4-(4-tert-butylbenzenesulfonyloxy)phenyl]-1,1,1,3,3,3-hexafluoropropane An oven-dried 50 ml 3-necked flask is equipped with a magnetic stirring bar and a reflux condenser carrying a $CaCl_2$ drying tube and is charged with 4-tert-butylbenesulfonyl chloride 8.14 grams (35 mmol), 4,4'-hexafluoroisopropylidenediphenol (5.37 grams, 16 mmol), 4-dimethylaminopyridine (0.1 grams, 0.8 mmol), and anhydrous pyridine (20 ml), and the mixture is stirred and heated at reflux for 15 hours. Workup consists of partitioning the mixture between $Et_2O$ and $H_2O$ (50 ml each), washing the organic phase successively with 100 ml portions of $H_2O$, 5 percent HCl, $H_2O$, saturated $NaHCO_3$, $H_2O$ and brine, then drying ($MgSO_4$), filtration and concentration. This gives 10.03 grams of a pale yellow oil. Crystallization from EtOH-MeOH (2:1) affords 7.53 grams (64 percent yield) of the title compound as white prisms, m.p. 177° C. to 180° C.

EXAMPLE 13

Preparation of Bis[4-(benzenesulfonyloxy)phenyl] Ether

An oven-dried 100 ml 3-necked flask is equipped with a magnetic stirring bar, a reflux condenser carrying a $CaCl_2$-Drierite drying tube, and a heating mantle, and is charged with 4,4'-oxydiphenol (Pfaltz & Bauer) (4.2 grams, 20.8 mmol), 4-dimethylaminopyridine (0.5 gram, 4.1 mmol), and anhydrous $Et_3N$ (40 ml), and the stirred solution is treated slowly with benzenesulfonyl chloride (6 ml, 47 mmol) via syringe. The resulting mixture is heated at reflux for 9 hours. Workup consists of partitioning the reaction mixture between $CH_2Cl_2$ (100 ml) and a mixture of water (150 ml) and concentrated HCl (40 ml), then washing the organic phase successively with 100 ml portions of water, 5 percent NaOH, water, and saturated brine. Drying ($MgSO_4$), filtration and concentration gives a red oily residue. TLC analysis on silica gel shows one major 5 component ($R_f$=0.36; $CH_2Cl_2$), and some minor more polar components. Chromatography on a column packed with flash-grade silica gel (6"×1" i.d.), eluting with $CH_2Cl_2$, gives 7.64 grams of a faintly yellowish oil, which solidifies on standing. Recrystallization from a mixture of EtOAc (20 ml) and water (10 ml) affords 6.23 grams (62 percent yield) of the title compound as a white crystalline solid, m.p. 129° C. to 130° C.

EXAMPLE 14

Preparation of Bis[4-(benzenesulfonyloxy)phenyl] Sulfide

A 100 ml 3-necked oven-dried flask is equipped with a magnetic stirring bar and a $CaCl_2$-Drierite drying tube and is charged with 4,4'-thiodiphenol (5.3 grams, 24.3 mmol), benzenesulfonyl chloride (6.5 ml, 50.9 mmol), 4-dimethylaminopyridine (0.59 grams, 4.8 mmol), and anhydrous pyridine (40 ml). The mixture is stirred at ambient temperature for 18 hours, and at reflux for 4 hours, then is poured into ice-cold water (100 ml) with vigorous stirring, and the yellow oil that separates is extracted into $CH_2Cl_2$ (100 ml), and washed with water (100 ml). Drying ($MgSO_4$), filtration and concentration affords a yellow oil. Purification by filtration through a column packed with flash-grade silica gel (5"×2" i.d.), eluting with $CH_2Cl_2$ (ca. 0.5 1), gives after solvent removal under vacuum 11.8 grams (98 percent yield) of the title compound as a faintly yellowish, thick glass material.

EXAMPLE 15

Lubricity Testing of Aryl Arenesulfonates

Three aryl arenesulfonates, compounds A-E15, B-E15, and C-E15 are prepared in accordance with the procedure of Example 1 having Formula I wherein R is 4-phenoxy and R' is 3-trifluormethylphenyl in compound A-E15, R is 4-methoxy and R' is 3-methoxyphenyl in compound B-E15, and R is 4-phenoxy and R' is hydrogen in compound C-E15. These compounds are tested using the ASTM Four-Ball method at 75° C., 40 Kg load, on M52100 steal balls, for one hour at 1200 rpm. The wear scar diameter is 0.551 mm for compound A-E15, 0.828 mm for compound B-E15, and 0.579 mm for compound C-E15. The coefficient of friction is approximately 0.098 for compound A-E15, approximately 0.095 for compound B-E15, and approximately 0.114 for compound C-E15.

Example 15 shows that the compositions of this invention are excellent lubricants when applied to metal surfaces.

What is claimed is:

1. A method for lubricating inorganic surfaces which comprises applying an aryl arenesulfonate between two inorganic surfaces in an amount sufficient to decrease the friction between the two surfaces, and moving the surfaces while the surfaces are in contact whereby friction between the surfaces is reduced relative to the friction between the surfaces in the absence of aryl arenesulfonate, wherein the aryl arenesulfonate is of the formula $ASO_3A$, $ASO_3BSO3A$, or $(ASO_3)_3B$ wherein A is independently in each occurrence phenyl or substituted phenyl, wherein when A is substituted phenyl the phenyl can be substituted by halo, a ketone substituted by an aromatic group containing up to 12 carbon atoms or alkyl group containing up to 10 carbons atoms, alkyl containing up to 10 carbon atoms, polyhaloalkyl containing up to 10 carbon atoms, alkoxy containing up to 10 carbon atoms polyhaloalkoxy containing up to 10 carbon atoms, aryl containing up to 12 carbons, aralkyl wherein the aryl group contains up to 12 carbon atoms and the alkyl group contains up to 10 carbon atoms, haloaryl containing up to 12 carbons and substituted by up to 10 halo groups, aryloxy containing up to 12 carbons, polyhaloaryloxy containing up to 12 carbons, polyhaloalkylaryl wherein the aryl group contains up to 12 carbon atoms and wherein the alkyl group contains up to 10 carbon atoms, or polyhaloalkylaryloxy wherein the aryl group contains up to 12 carbon atoms and wherein the alkyl group contains up to 10 carbon atoms, and wherein B is benzene or two benzene rings connected by a divalent bridging group selected from the group consisting of $C(CH_3)_2$, O, $OCH_2$, $OCH_2CH_2$, $OCH_2CH_2O$, $C(CF_3)_2$, S, $SO_2$, CO, and 9,9'-fluorene.

2. The method of claim 1 wherein A is substituted phenyl and the halo substituent is fluoro or chloro.

3. The method of claim 1 wherein A is substituted phenyl and the ketone substituent is methyl ketone or phenyl ketone.

4. The method of claim 1 wherein A is substituted phenyl and the alkyl substituent is an alkyl group containing up to eight carbons.

5. The method of claim 4 wherein the alkyl substituent is methyl, t-butyl, or 1,1,3,3-tetramethylbutyl.

6. The method of claim 1 wherein A is substituted phenyl and the polyhaloalkyl substituent is polyfluoroalkyl wherein the alkyl contains up to eight carbon atoms.

7. The method of claim 6 wherein the polyhaloalkyl substituent is trifluoromethyl.

8. The method of claim 1 wherein A is substituted phenyl and the alkoxy substituent is an alkoxy group containing up to seven carbon atoms.

9. The method of claim 8 wherein the alkoxy substituent is methoxy, n-butoxy, n-hexoxy, or n-heptoxy.

10. The method of claim 1 wherein A is substituted phenyl and the aralkyl substituent is tri-t-butylphenyl.

11. The method of claim 1 wherein A is substituted phenyl and the haloaryl substituent is fluorophenyl.

12. The method of claim 1 wherein A is substituted phenyl and the polyhaloalkoxy group is polyfluoroalkoxy.

13. The method of claim 12 wherein the polyhaloalkoxy substituent is trifluoromethoxy, 1,1,3,3,3-pentafluoro-n-propoxy, or 1,1,2,3,3,3-penta-fluoro-n-propoxy.

14. The method of claim 1 wherein A is substituted phenyl and the polyhaloalkylaryl substituent is trifluoromethylphenyl.

15. The method of claim 1 wherein A is substituted phenyl and the aryloxy group is phenoxy.

16. The method of claim 1 wherein A is substituted phenyl and the divalent bridging group is $C(CH_3)_2$, O, $C(CF_3)_2$, S, CO, or 9,9'-fluorene.

17. The method of claim 1 wherein the aryl arenesulfonate is of Formula I:

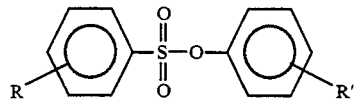

wherein R is hydrogen, 4-methyl, 4-t-butyl, 4-methoxy, 4-n-butoxy, 4-phenoxy, 4-trifluoromethoxy, or 4-(1,1,2,3,3,3-hexafluoro)-n-propoxy; R' is hydrogen, 4-t-butyl, 3-methoxy, 4-methoxy, 3-n-butoxy, 3-phenoxy, 4-(1,1,3,3-tetra methyl)butyl, 2-t-butyl, 4-n-butoxy, 4-n-hexoxy, 3-methyl, 3-fluoro, 3-trifluoromethyl, 4-methyl ketone, or 4-phenyl ketone; or of Formula II:

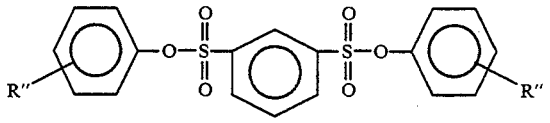

wherein R'' is 3-methoxy, 3-trifluoromethyl, 3-phenoxy, 4-phenoxy, 4-(4-chloro)phenoxy, or (1,1,3,3-tetramethyl)butyl.

* * * * *